US010807126B2

(12) United States Patent
Cogan et al.

(10) Patent No.: US 10,807,126 B2
(45) Date of Patent: Oct. 20, 2020

(54) SEPARATION APPARATUS WITH SCREEN HAVING FIXED, NON-UNIFORM OPENINGS

(71) Applicant: Frito-Lay North America, Inc., Plano, TX (US)

(72) Inventors: Kevin C. Cogan, Oak Point, TX (US); Joseph H. Gold, Dallas, TX (US)

(73) Assignee: Frito-Lay North America, Inc., Plano, TX (US)

( * ) Notice: Subject to any disclaimer, the term of this patent is extended or adjusted under 35 U.S.C. 154(b) by 0 days.

(21) Appl. No.: 16/445,850

(22) Filed: Jun. 19, 2019

(65) Prior Publication Data

US 2019/0299253 A1 Oct. 3, 2019

Related U.S. Application Data

(62) Division of application No. 15/440,267, filed on Feb. 23, 2017, now Pat. No. 10,376,924.

(51) Int. Cl.

| | |
|---|---|
| ***B07B 13/16*** | (2006.01) |
| ***B07B 1/46*** | (2006.01) |
| ***B07B 1/28*** | (2006.01) |
| ***B07B 13/07*** | (2006.01) |
| ***B07B 1/06*** | (2006.01) |

(52) U.S. Cl.

CPC ..... *B07B 13/16* (2013.01); *B07B 1/06* (2013.01); *B07B 1/28* (2013.01); *B07B 1/469* (2013.01); *B07B 1/4681* (2013.01); *B07B 13/07* (2013.01)

(58) Field of Classification Search

CPC .... B07B 1/00; B07B 1/04; B07B 1/06; B07B 1/28; B07B 1/46; B07B 1/4609; B07B 1/4618; B07B 13/04; B07B 13/07; B07B 13/16

USPC ..... 209/243, 248, 263, 264, 392, 397, 400, 209/401

See application file for complete search history.

(56) References Cited

U.S. PATENT DOCUMENTS

| | | | | |
|---|---|---|---|---|
| 2,751,079 | A * | 6/1956 | Ahlmann | B07B 7/08 209/295 |
| 5,039,465 | A * | 8/1991 | Freeman | B29B 11/16 162/116 |
| 5,064,537 | A * | 11/1991 | Chupka | B01D 29/111 210/497.01 |
| 5,137,621 | A * | 8/1992 | Brown | B07B 1/15 209/234 |
| 6,837,380 | B2 * | 1/2005 | Stoner | B65G 69/12 209/240 |
| 7,216,768 | B2 * | 5/2007 | Fisher | B01D 33/0376 209/395 |

(Continued)

*Primary Examiner* — Terrell H Matthews

(74) *Attorney, Agent, or Firm* — Barnes & Thornburg LLP; G. Peter Nichols

(57) ABSTRACT

A novel separation screen, a separation apparatus utilizing the separation screen, and a method for product separation are disclosed herein. The separation apparatus includes a housing defining a separation chamber having an inlet and a plurality of outlet orifices. A separation screen, which is located within the separation chamber, has a plurality of openings having fixed, non-uniform sizes. The separation apparatus also includes an adjustable feed placement device located upstream from the separation screen to direct a feed stream to a selected region of the separation screen to achieve a desired size distribution in each of the product streams.

10 Claims, 10 Drawing Sheets

(56) References Cited

U.S. PATENT DOCUMENTS

| | | | | |
|---|---|---|---|---|
| 8,813,970 | B2 * | 8/2014 | Jones | B07B 1/4618 209/408 |
| 2002/0168228 | A1 * | 11/2002 | Benedict | E02B 3/06 405/21 |
| 2003/0205067 | A1 * | 11/2003 | Arterburn | C03B 37/08 65/471 |
| 2010/0078362 | A1 * | 4/2010 | Riise | B03C 1/01 209/3.3 |
| 2015/0202658 | A1 * | 7/2015 | Bakula | B07B 1/48 209/403 |

* cited by examiner

SEPARATION APPARATUS WITH SCREEN HAVING FIXED, NON-UNIFORM OPENINGS

CROSS REFERENCE TO RELATED APPLICATION

This application is a divisional patent application of U.S. Ser. No. 15/440,267 entitled "Separation Apparatus with Screen Having Fixed, Non-Uniform Openings" filed on Feb. 23, 2017, the technical disclosure of which is hereby incorporated herein by reference.

BACKGROUND OF THE INVENTION

Technical Field

The present invention disclosure relates generally to a method and apparatus for separating products based on size. More particularly, the disclosure herein describes an improved separation apparatus with a novel separation screen having openings of fixed, but non-uniform sizes arranged in a size-based gradient. Depositing a feed stream onto a selected region of the separation screen separates the feed stream into product streams with a desired size distribution.

Background

A vibratory screener, also referred to herein as a sifter, is a separation apparatus that can separate a feed stream into two or more product streams, each having particles of different sizes. There are two predominant types of vibratory screeners: centrifugal screeners and longitudinal screeners. Currently existing centrifugal screeners use one or more circular screens to separate a feed stream into two or more product streams based on size of particles that form the feed stream. In particular, separation is achieved by vibrating a separation screen on which the feed stream has been deposited. Larger particles unable to pass through the holes in the separation screen are removed from the centrifugal screener as a retained product stream. Smaller particles of the feed stream fall through the holes in the screen during agitation are often collected as a pass-through product stream.

A longitudinal screener uses one or more rectangular screens to separate a feed stream into two or more product streams. The particles of a feed stream are deposited onto the upstream end of a separation screen and then vibrated to cause the particles of the feed stream to travel down a length of the separation screen. Larger particles unable to pass through the holes in the separation screen are removed at a downstream end of the separation screen as a retained product stream. Smaller particles of the feed stream fall through the holes in the screen during agitation and are often collected as a pass-through product stream.

To change the size distribution of particles in the product streams, an installed separation screen would need to be replaced with another screen having uniform holes of a different size to achieve the desired separation. Alternatively, one or more additional screens may be added in series to change the size of particles in the product streams. However, this is time consuming because it requires a technician to take the vibratory screener apart and make the necessary changes. The production line needs to be shut down temporarily, which reduces throughput and profit.

SUMMARY OF THE INVENTION

In a first embodiment, the present disclosure provides for a separation apparatus for product separation. The separation apparatus has a housing defining a separation chamber with an inlet and a plurality of outlet orifices. A separation screen, which is located within the separation chamber, includes a plurality of openings having fixed, non-uniform sizes. The separation apparatus also includes an adjustable feed placement device located upstream from the separation screen, which directs a feed stream to a selected region of the separation screen.

Relative terms, such as "upstream" and "downstream," may be used to describe relative locations, and also the relative placement of system components. The direction of product flow dictates the interpretation of "upstream" and "downstream." For example, a separation chamber has an upstream end where a feed stream is introduced and a downstream end where separated product streams are removed. Likewise, a separation screen positioned within the separation chamber may be located downstream from an inlet, but upstream from an outlet orifice.

In a second embodiment, the present disclosure provides for a separation screen having a plurality of openings having fixed, non-uniform sizes. At least a portion of the plurality of openings are arranged in a pattern displaying a size-based gradient.

In a third embodiment, the present disclosure provides for a method for product separation. In a first step, a feed placement device is adjusted to deposit a feed stream onto a selected region of a separation screen, which has a plurality of openings having fixed, non-uniform sizes. Particles of the feed stream are deposited onto the selected region of the separation screen. Thereafter, the feed stream is separated into a retained product stream and a pass-through product stream.

Other aspects, embodiments and features of the invention will become apparent from the following detailed description of the invention when considered in conjunction with the accompanying drawings. The accompanying figures are schematic and are not intended to be drawn to scale. In the figures, each identical, or substantially similar component that is illustrated in various figures is represented by a single numeral or notation. For purposes of clarity, not every component is labeled in every figure, nor is every component of each embodiment of the invention shown where illustration is not necessary to allow those of ordinary skill in the art to understand the invention.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION

Novel aspects of the present disclosure relate generally to a system utilizing separation screens having holes of fixed, but non-uniform sizes, specifically arranged to allow an operator to change the size distribution of particles in the product streams by changing the location of a separation screen on which a feed stream is deposited. The system and associated screen reduce costs by reducing the number of screens that must be maintained, and by reducing the number of technicians that must be employed to change out screens. Profits may be increased by minimizing the amount of production downtime ordinarily allocated to screen changes. Other benefits will be become apparent as the novel aspects are disclosed in further detail.

Figure 1:
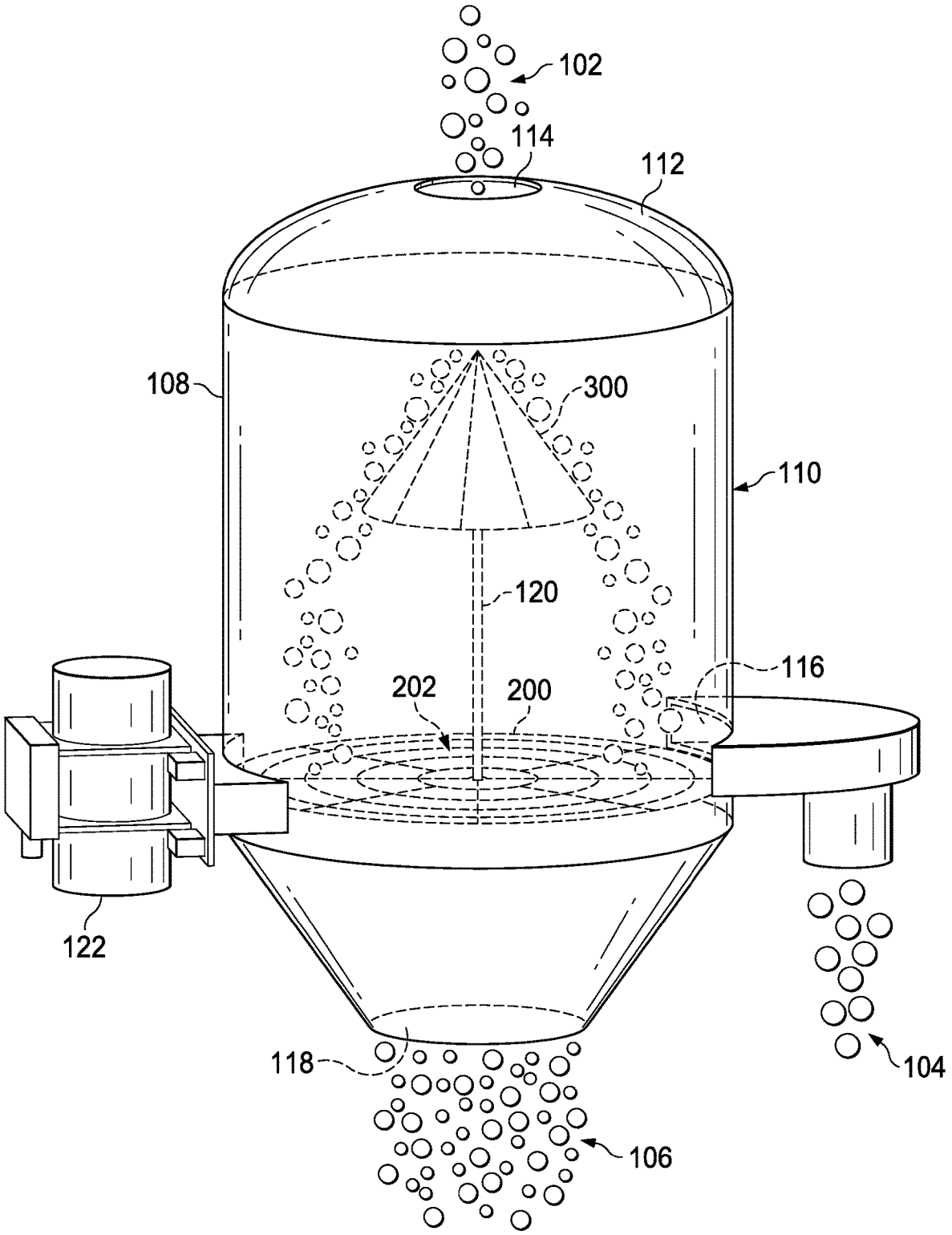
FIG. 1 is an exemplary centrifugal separation apparatus for product separation in accordance with an illustrative embodiment.

FIG. 1 is a separation apparatus in accordance with an illustrative embodiment. Separation apparatus 100 is a centrifugal screener configured to separate a feed stream 102 into a plurality of product streams based on particle sizes. The feed stream 102 may be formed from any type of separable product, edible or inedible, which includes particles of variable sizes. A non-limiting list of edible product that can form feed stream 102 includes chips, granola clusters, extruded snacks, or ingredients used in food or snack processing.

A feed stream 102 introduced into a separation apparatus 100 can be separated into two product streams by utilizing a separation screen 200 having a plurality fixed-size, non-uniform openings dispersed throughout. A fixed-size opening is an opening in a separation screen that is designed to maintain its size during normal operation. Traditional separation screens have fixed-size openings that are uniform in size. In contrast, the fixed-size openings of separation screen 200 have non-uniform sizes. Thus, the plurality of openings on the operative surface of separation screen 200 are not all the same size.

The operative surface 202 of separation screen 200 is generally flat and may be formed from woven strands of wire or polymeric line and reinforced around the perimeter by a rigid frame. In an alternate embodiment, the operative surface may be formed from a single sheet of material, such as plastic or metal, with openings disposed throughout. The openings may be formed by boring through the sheet of material or thermoformed with the openings already integrated therein. These examples are illustrative and should not be construed as limiting.

Separation screen 200 separates a feed stream 102 into a retained product stream 104 and a pass-through product stream 106. The retained product stream 104 is formed from particles of the feed stream 102 which did not pass through the openings of the separation screen 200. In contrast, the pass-through product stream 106 is formed from particles of the feed stream 102 which have passed through a separation screen 200.

In the depicted embodiment, separation apparatus 100 includes a housing 108 with an internal separation chamber 110 defined by a curved sidewall that forms a hollow cylinder. At the upper end of the separation chamber 110 is dust cover 112 having an inlet orifice 114 that enables a feed stream 102 to enter the separation chamber 110 of the separation apparatus 100. The separation apparatus 100 also includes a first outlet orifice 116 and a second outlet orifice 118, which permit the retained product stream 104 and the pass-through product stream 106 to be removed from the separation chamber 110, respectively.

Suspended within the separation chamber 110 is a separation screen 200 that is sized to span the cross-sectional area of the separation chamber 110. The separation screen 200 has a plurality of fixed-size, non-uniform openings configured to separate a feed stream 102 based on the size of its constituent particles. As used herein, the term "particle" refers to any singular item that can form a feed stream 102. For example, if the feed stream 102 is formed from a collection of potato chip pieces, then a particle is a potato chip. If the feed stream 102 is a stream of oat clusters, then a particle is one oat cluster. Because feed stream 102 is not limited to food items, the particles can be anything. For example, if feed stream 102 is crushed granite, then a particle is a piece of granite.

The particular arrangement of the fixed-size, non-uniform openings disposed throughout the separation screen 200 forms a pattern that can be used to easily change the size distribution of the particles in each of the product streams. In particular, the size distribution of the particles in each of the product streams can be changed simply by changing the region of the separation screen 200 on which the feed stream 102 is deposited so that the particles of the feed stream 102 engage openings of one or more particular sizes. Thus, in one embodiment, the openings of a separation screen 200 are arranged to form a size-based gradient with smallest openings in one or more defined regions, and the largest openings in one or more different regions, but separated from the smallest openings by openings of gradually changing sizes. For example, in the exemplary separation screen 200*a* in FIG. 2, the openings located in the middle of the separation screen 200 are the largest. The size of the openings decrease steadily as their radial distance increases so that the smallest openings are located along the perimeter of the separation screen 200. In another embodiment, a separation screen may have a plurality of discrete regions, each of which may be described as having its own size-based gradient.

In this illustrative embodiment in FIG. 1, a feed hat 300 controls the directional flow of feed stream 102 through separation chamber 110 so that the particles of feed stream 102 can be deposited onto a selected region of separation screen 200. Feed hat 300 is a feed placement device suspended within the separation chamber 110 above the separation screen 200 and in the path of the incoming feed stream that enters through inlet orifice 114. In this illustrative embodiment, feed hat 300 is suspended by a vertical support member 120 extending upwardly from the center of separation screen 200. However, in alternate embodiments, feed hat 200 may be suspended from supports extending from the dust cover 112 or from the interior surface of the curved sidewall.

Feed hat 300 has a generally conical shape, oriented with its apex facing in the direction of the incoming feed stream 102 and controls the directional flow of feed stream 102 by altering its dimensions, and in particular its effective diameter. The effective diameter of feed hat 300 is the diameter of its base. For example, maximizing the effective diameter of the base of feed hat 300 causes particles of the feed stream 102 to fall on the outer perimeter of separation screen 200 to achieve product streams having a first size distribution. Minimizing the effective diameter of the base of feed hat 300 causes particles of the feed stream 102 to pass essentially unobstructed from the inlet orifice 114 to the separation screen 200, which permits recovery of product streams having a second, different size distribution. As used herein, a feed hat 300 with the smallest achievable effective diameter may also be referred to herein as being in a closed configuration. Similarly, a feed hat 300 with the largest achievable effective diameter may also be referred to herein as being in a fully opened configuration. Thus, a feed hat 300 having an effective diameter that is between its smallest diameter and largest diameter will also be described herein as being "partially opened."

The effective diameter of feed hat 300 may be changed by any currently existing or later developed means. For example, feed hat 300 may be an electro-mechanical device controlled by servos maintained in the volume beneath the operative surface that engages the feed stream 102. In this embodiment, power may be supplied by wires concealed within the vertical support member 120. In an alternate embodiment, feed hat 300 may be an unpowered device where the effective diameter is controlled by manually adjustable mechanisms. For example, in one non-limiting embodiment, the effective diameter may be controlled by a cylindrical sleeve encircling the vertical support member 120 and in contact with the moveable segments of the feed hat so that the cylindrical sleeve can be moved to different heights to control the effective diameter of the feed hat 300, much like an umbrella. Dials or rotating handles are other examples of conventional adjusting mechanisms that may be implemented.

In the illustrative embodiment in FIG. 1, feed hat 300 controls where particles of a feed stream 102 are deposited onto a separation screen 200 by changing its effective diameter. In an alternate embodiment, a feed hat having a fixed size but variable height may be used to control where the feed stream is deposited onto a separation screen. In this alternate embodiment, vertical support member 120 may be a telescoping support member capable of adjusting a height of an attached feed hat 300. In addition, or in the alternative, adjusting the rate and/or velocity at which the feed stream is injected into the inlet orifice 114 may be used to control, at least partially, where the feed stream is deposited onto the separation screen. For example, increasing the velocity at which the particles of a feed stream 102 enter the separation chamber and engage the feed hat 300 causes particles of the feed stream 102 to fall closer to the outer perimeter of the separation screen 200 relative to particles of a feed stream 102 that are introduced at a lower velocity.

Product separation is achieved within separation chamber 110 by agitating the particles of the feed stream 102 as they are in contact with separation screen 200. Agitation is achieved by vibration device 122, which is depicted as affixed to an exterior surface of the housing 108 in this embodiment. The agitation imparts centrifugal motion to any particles of feed stream 102 on separation screen 200, which causes smaller particles to pass through the separation screen 200 and pushes the larger particles to the periphery of the separation screen 200 for subsequent removal. Vibration device 122 may be any form of currently existing or later developed vibration-inducing device. Further, the vibration device 122 may be mounted in another location. For example, vibration device 122 may be mounted on a frame (not shown) supporting the housing 108.

In one embodiment, separation apparatus 100 may be designed to allow a feed stream 102 to pass through the separation apparatus 100 without any meaningful separation. Thus, when feed hat 300 is in the fully closed configuration, substantially all particles in feed stream 102 fall through separation chamber 110 and through the largest openings in the separation screen 200 without substantial redirection by feed hat 300 and exit the separation chamber 110 without meaningful separation by separation screen 200. In this particular embodiment, the largest opening(s) are located directly beneath the inlet orifice 114 of dust cover 112. By extending feed hat 300, feed stream 102 is diverted away from the central region of the separation screen 200 which causes the particles of feed stream to engage the separation screen 200, resulting in product separation. In another embodiment, if at least a minimum amount of separation is desired, then the fully closed configuration of feed hat 300 may cause the feed stream 102 to fall onto a portion of separation screen 200 that results in product separation.

Figure 2A:
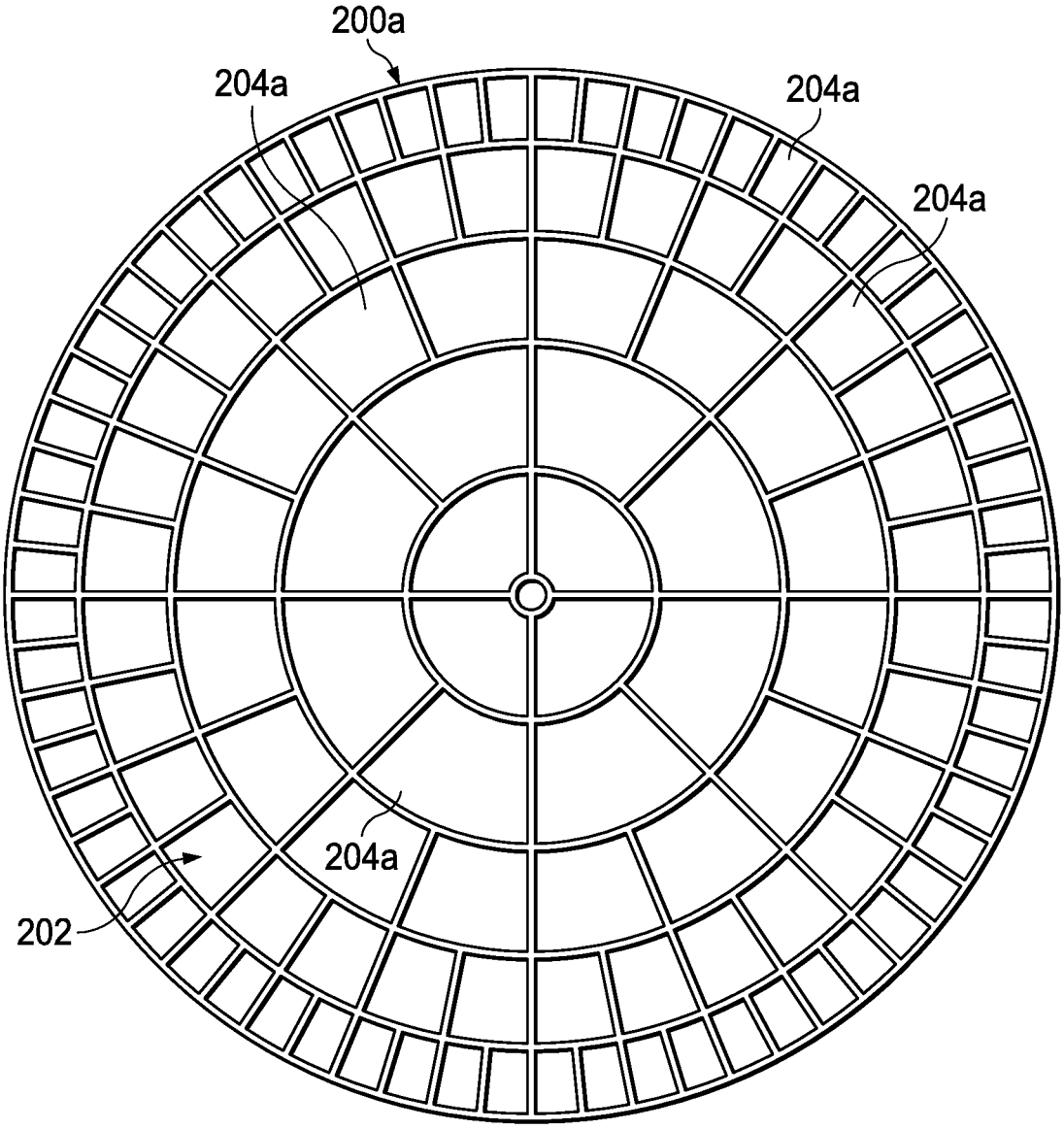
FIGS. 2*a* and 2*b* are exemplary separation screens for a centrifugal separation apparatus in accordance with two illustrative embodiments.
Figure 2B:
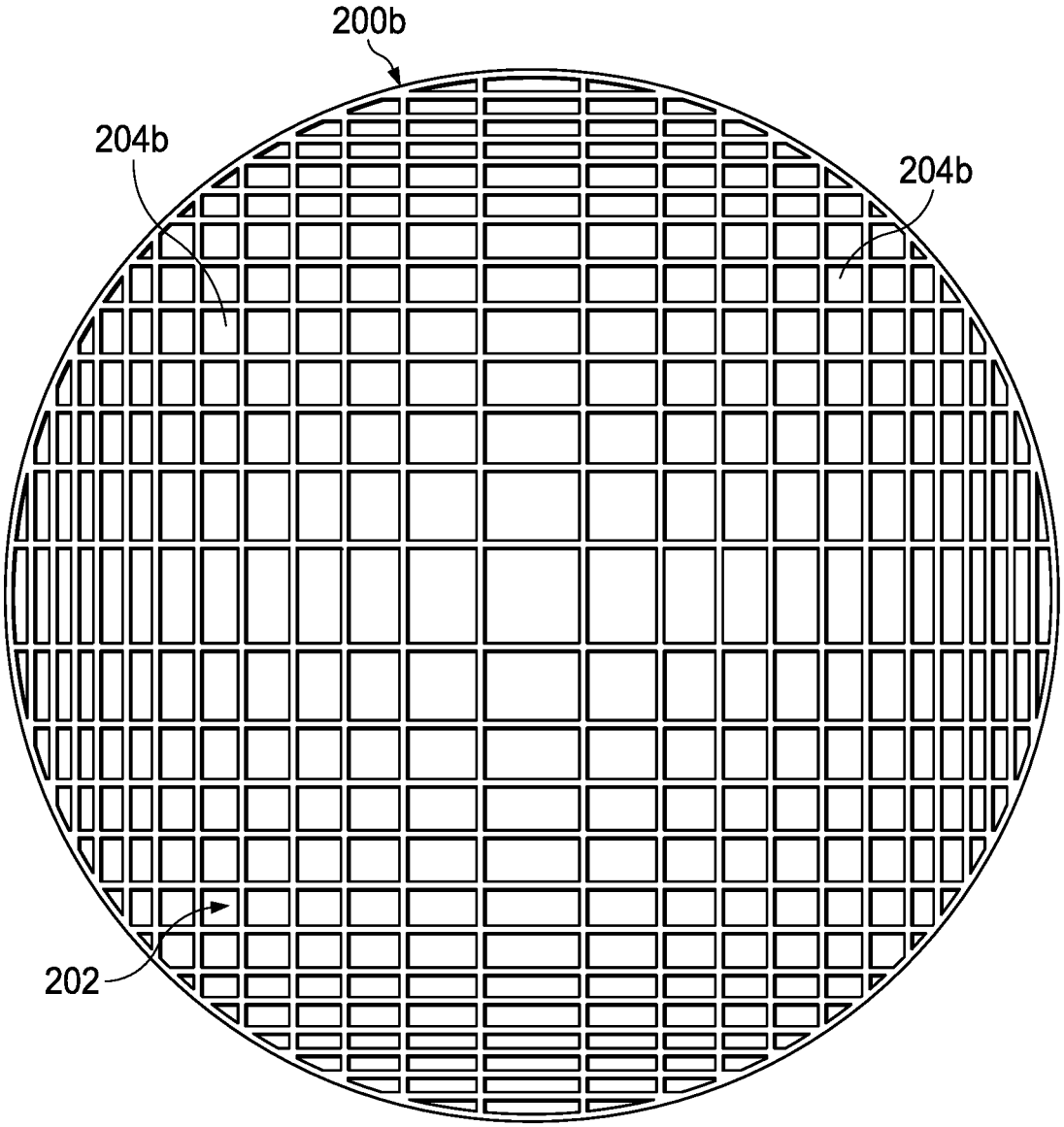

FIGS. 2*a* and 2*b* depict two exemplary separation screens in accordance with non-limiting embodiments. The separation screens 200*a* and 200*b* can be used in a separation apparatus, such as separation apparatus 100 in FIG. 1, to separate a feed stream into a plurality of product streams. Separation screens 200*a* and 200*b* have fixed, non-uniform openings 204*a*, 204*b* disposed throughout their respective operative surfaces 202 which can be used to separate the particles of a feed stream based on size. As previously mentioned, separation is achieved by depositing the particles of a feed stream onto a selected region of the separation screen 200*a* and/or 200*b*, and agitating the particles to impart centrifugal motion. As the particles move along the operative surface 202 of the separation screen 200*a* and/or 200*b*, smaller particles pass through the screen and larger particles are retained above the screen.

Separation screen 200*a* in FIG. 2*a* has a plurality of openings arranged in a size-based gradient where the largest openings 204*a* in the central region. The openings 204*a* gradually decrease in size as the radial distance of the aperture 204*a* from the center increases so that the smallest openings 204*a* are located around the perimeter of the separation screen 200*a*.

To illustrate the operation of separation screen 200*a*, a hypothetical feed stream formed from only small, medium, and large particles is introduced into a separation apparatus 100 outfitted with separation screen 200*a*. Particles from the feed stream deposited onto a selected region of separation screen 200*a* proximate to the perimeter would yield a pass-through product stream having only the small particles capable of passing through the openings 204*a* in that selected region. The retained product stream would be formed from large particles and medium particles incapable of passing through the openings 204*a* in that selected region. In the event that the hypothetical feed stream is deposited onto a selected region located proximate to the central region of the separation screen 200*a*, then the pass-through product stream would include medium particles and small particles capable of passing through the openings 204*a* in that selected region. Only the large particles of the feed stream incapable of passing through the separation screen 200*a* at that selected region would be included in the retained product stream. Finally, depositing the feed stream onto a selected region between the perimeter and the central region will yield a pass-through product stream that may have a mixture of small particles and medium particles and/or a retained product stream that may also have a mixture of medium particles and large particles.

In another embodiment, the openings 204*a* in the central region of separation screen 200*a* are large enough to pass even the largest particles of a feed stream. Thus, all particles of a feed stream may be capable of falling unimpeded through the separation chamber from the inlet orifice all the way through to the outlet orifice, which could be useful in the event that no separation is required. In this embodiment, enlarging the effective diameter of the feed hat would redirect the feed stream to a selected region having openings 204*a* that would yield a retained product stream as well as a pass-through product stream.

In real world applications, where the particles sizes of a feed stream have more than three distinguishable sizes, the size distribution of the particles in each of the product streams may be attained by depositing a feed stream onto selected regions of the separation screen 200 which has been previously correlated with known results. For example, tests may be conducted in a lab environment with selected screens and commonly encountered feed streams to determine which selected regions of the selected screens will yield product streams having consistent and reproducible size distributions.

Another exemplary screen pattern is depicted in separation screen 200*b* of FIG. 2*b*. In particular, separation screen 200*b* has a plurality of openings 204*b* formed from wire or wire mesh stretched between two points on the outer frame. The plurality of openings 204*b* in this non-limiting embodiment are arranged in a size-based gradient so that the openings in the central region of the separation screen 200*b* are generally larger than the openings around the perimeter of the separation screen 200*b*.

Figure 3A:
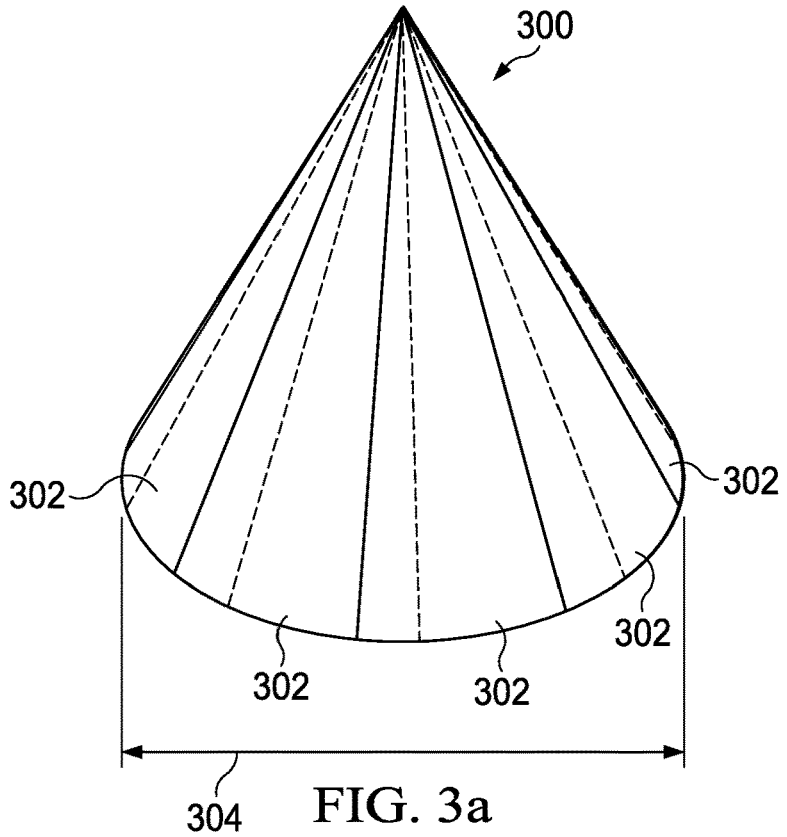
FIGS. 3*a*-3*d* are different views of an exemplary feed hat in accordance with an illustrative embodiment.
Figure 3B:
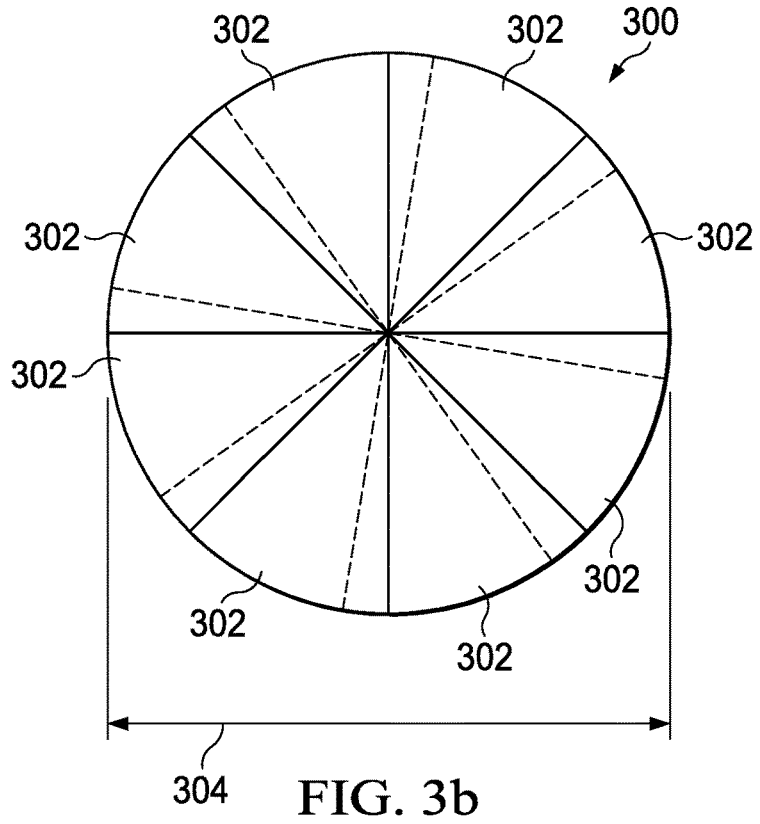
Figure 3D:
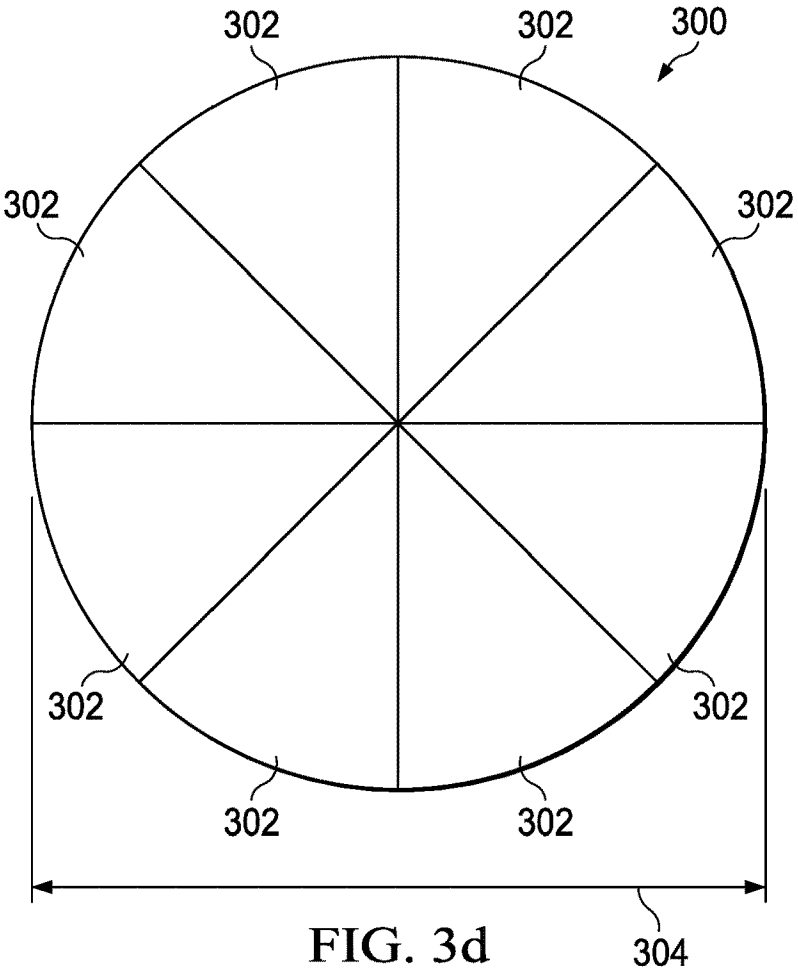
Figure 3C:
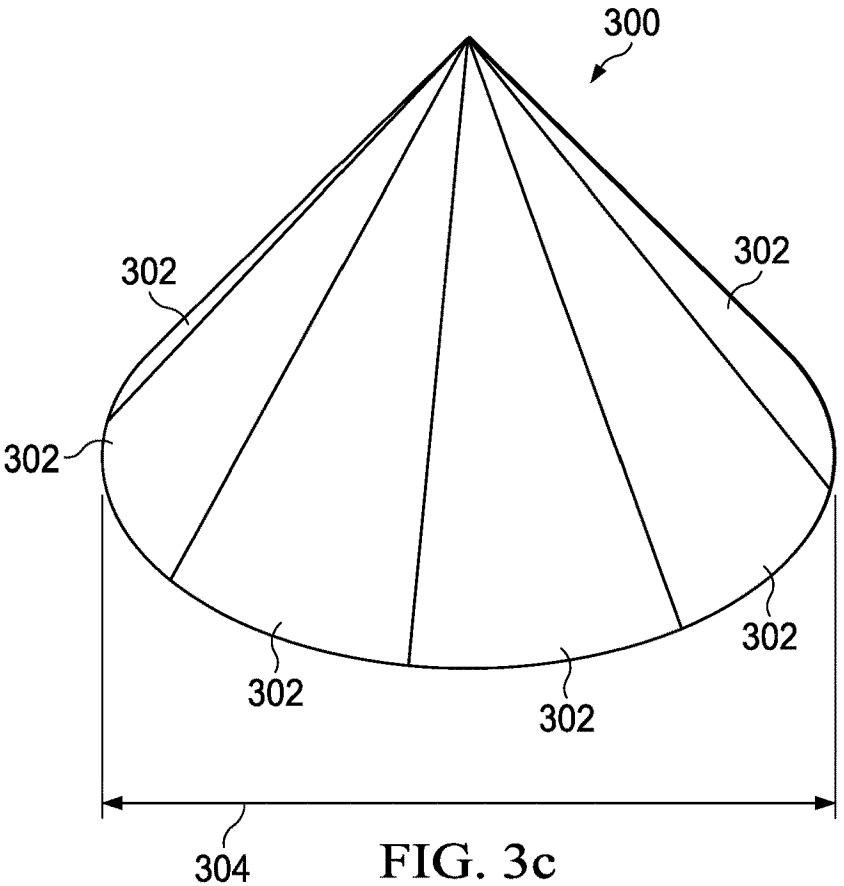

FIGS. 3*a*-3*d* are different views of an exemplary feed hat in accordance with an illustrative embodiment. In particular, FIG. 3*a* depicts a perspective view of feed hat 300 in a partially open configuration. FIG. 3*b* is a top view of the corresponding feed hat 300 shown in FIG. 3*a*. FIG. 3*c* is a perspective view of a feed hat 300 in a fully opened configuration. FIG. 3*d* is a top view of the corresponding feed hat 300 shown in FIG. 3*c*.

In the illustrative embodiments in FIGS. 3*a*-3*d*, feed hat 300 is formed from a plurality of segments 302 that can be adjusted to change the effective diameter 304 of feed hat 300. As previously mentioned, maximizing the amount of overlap among the segments 302 reduces the effective diameter 304 of feed hat 300 and causes the feed hat 300 to assume a closed configuration. Minimizing the amount of overlap among the segments 302 increases the effective diameter 304 of feed hat 300 and causes the feed hat 300 to assume a fully opened configuration. By adjusting the amount of overlap among the segments 302, a partially opened configuration may be attained for depositing a feed stream to a selected region on a separation screen.

FIG. 3*a* depicts feed hat 300 in a partially open configuration with a partial overlap of segments 302 as indicated by the dotted lines. In contrast, FIG. 3*c* depicts feed hat 300 in a fully opened configuration with no overlap among the segments 302. The effective diameter 304 for feed hat 300 in FIGS. 3*a* and 3*b* is smaller than the effective diameter 304 for feed hat 300 in FIGS. 3*c* and 3*d*.

In one embodiment, the plurality of segments 302 may be formed from a rigid material, such as food-grade stainless steel. In another embodiment, the set of segments 302 may be formed from a flexible material, such as plastic or other polymeric film. Furthermore, in this illustrative example, the feed hat 300 was depicted as generally conical with a plurality of triangularly shaped segments 302 adjustable to change the effective diameter 304 of feed hat 300; however, in alternate embodiments, the feed hat 300 may take on another shape with adjustable segments that are non-triangular but still capable of altering the effective diameter 304 to enable the deposit of a feed stream onto a selected region of a separation screen.

Figure 4:
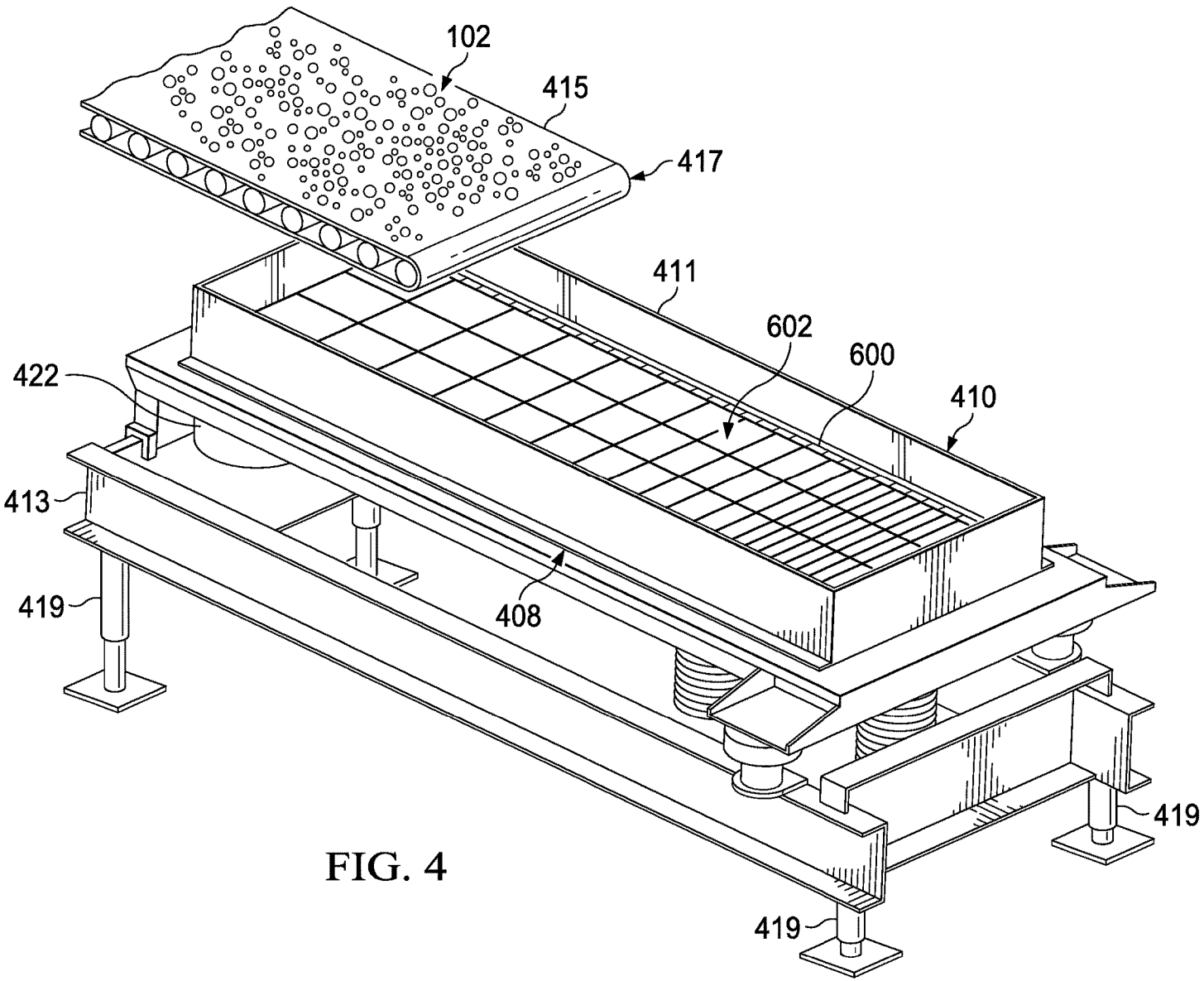
FIG. 4 is a perspective view of an exemplary longitudinal separation apparatus in accordance with an illustrative embodiment.

FIG. 4 is a perspective view of a separation apparatus in accordance with another illustrative embodiment. Separation apparatus 400 is a longitudinal screener utilizing a rectangular separation screen 600 to separate particles of a feed stream 102 into a plurality of product streams based upon a size of the particles. More specifically, particles of the feed stream 102 are introduced into the separation apparatus 400 at an upstream location and conveyed down an operative surface 602 of the separation screen 600. Particles small enough to pass through the openings of the separation screen are collected at a downstream location as a pass-through product stream 106. Particles that fail to pass through the openings are collected at another downstream location as a retained product stream 104.

The separation apparatus 400 has a housing 408 defining a separation chamber 410, which is an elongated volume of space in which product separation is conducted. In this illustrative embodiment, the separation chamber 410 is depicted as an open, uncovered chamber with raised sidewalls 411 to maintain particles of the feed stream 102 on the separation screen 600. The inlet in this illustrative embodiment in FIG. 4 is the open area through which particles of a feed stream may be introduced to engage the separation screen 600. In another embodiment, the separation chamber 410 may be bounded on the upper end by a lid to at least partially enclose the separation chamber 410 and reduce the amount of dust released into the production environment and minimize the likelihood that foreign objects may be packaged with the particles that eventually form the product streams.

Mounted within the separation chamber 410 is a separation screen 600. As with the separation screen 200 described in FIGS. 1 and 2, the separation screen 600 shown in FIG. 4 also includes a plurality of fixed-size, non-uniform openings dispersed throughout the operative surface 602 and arranged in a pattern that enables the feed stream 102 to be separated into product streams having particles of a particular size based on the region of the separation screen 600 onto which the feed stream 102 is deposited. Exemplary separation screens 600 are shown in more detail in FIG. 6.

The housing 408 is moveably mounted to a frame 413 so that the housing 408 and the separation screen 600 maintained therein may be vibrated sufficiently to cause particles of a feed stream 102 resting on separation screen 600 to travel down a length of the separation screen 600, which achieves product separation. Once separated, the retained product stream exits the separation chamber 410 through a first outlet orifice, and the pass-through product stream exits the separation chamber 410 through a second outlet orifice. The separation of a feed stream 102 into a retained product stream and a pass-through product stream is shown in more detail below in FIG. 5.

In one embodiment, the upstream end of the housing 408 is attached to a vibration device 422 that is in turn mounted to the frame 413. The downstream end of the housing 408 is supported by but moveably engaged with the frame 413 so that the vibration device 422 can cause the housing 408 to move while frame 413 is maintained stationary. In this embodiment, vibrating the upstream end of the housing 408 causes particles of a feed stream 102 resting on the operative surface 602 of the separation screen 600 to travel toward the downstream end of the housing 408. However, the placement of the vibration device 422 and the manner in which the housing 408 is vibrated is illustrative and non-limiting.

In this embodiment shown in FIG. 4, feed stream 102 is deposited onto a selected region of a separation screen 600 by an adjustable conveyor 415 suspended above or beside separation screen 600. Adjustable conveyor 415 is a feed placement device that can change a position of its terminal end 417 relative to a fixed position on the separation screen 600, such as the upstream end of separation screen 600. The terminal end 417 of the adjustable conveyor 415 is the end from which the feed stream 102 falls to engage the separation screen 600.

In the depicted embodiment adjustable conveyor 415 is oriented in-line with the separation screen 600 so that the direction of movement of the particles of the feed stream 102 transferred from the adjustable conveyor 415 to the separation screen 600 is unchanged. Further, the orientation of the adjustable conveyor 415 relative to the separation screen 600 is such that extension and retraction of adjustable conveyor 415 will either increase or decrease the amount of overlap between the adjustable conveyor 415 and the separation screen 600. By changing a position of the terminal end 417 of the adjustable conveyor 415 relative to a fixed position on the separation screen 600, the feed stream 102 can be deposited onto a selected region of the separation screen 600 that can be used to obtain product streams having particles of a desired size distribution.

Although FIG. 4 depicts the adjustable conveyor 415 as suspended at least partially above and in-line with the separation screen 600, in another embodiment the adjustable conveyor 415 may be oriented perpendicularly to the separation screen 600. In this embodiment, the adjustable conveyor may be located at a height that is level with or above the separation screen 600. In this embodiment, the adjustable conveyor can change where the feed stream 102 is deposited onto the separation screen by changing a position of the terminal end 417 of the adjustable conveyor to any position along the longitudinal side of the separation screen 600.

In yet another embodiment, the feed placement device may take the form of an adjustable chute or slide suspended above or beside the separation screen 600. Selection of a particular feed placement device among the various options will be determined, at least in part, by the type of product that form a feed stream. For example, for more fragile items like potato chips, a conveyor may be preferable. In contrast, hardier products like clusters may be transported through a chute or slide. Regardless of the type of feed placement device selected, the terminal end should be repositionable so that the particles of the feed stream may be deposited at any location on the separation screen 600.

Separation apparatus 400 may include a set of adjustable legs 419. In this non-limiting example in FIG. 4, each of the adjustable legs is attached to a corner of the frame 413 that supports the housing 408. By manipulating/modifying a height of the adjustable legs 419 the angle of elevation 421 may be altered. Thus, increasing the height of adjustable legs 419 at the upstream end of the housing 408 relative to the height of the adjustable legs 419 located at the downstream end of the housing 408, the angle of elevation 421 can be increased. As used herein, the angle of elevation 421 is increased when the upstream end of the housing 408 is raised relative to the downstream end of the housing 408.

The angle of elevation 421 can be used to help control the rate at which particles of the feed stream 102 travel along the length of the separation screen 600. A larger angle of elevation 421 would allow particles of the feed stream 102 to travel more quickly down the separation screen. As a result, particles that might otherwise be separated out into a pass-through stream may be collected as a retained product stream. In addition, increasing the angle of elevation 421 also changes the effective size of the openings disposed throughout separation screen 600, which would also yield a retained product stream that might include particles that could otherwise be separated out into the pass-through product stream. For example, in this embodiment shown in FIG. 4, by maintaining the position and orientation of adjustable conveyor 415 and increasing the angle of elevation 421, the effective size of the openings on separation screen 600 is decreased.

Although the separation apparatus 400 is depicted as having four adjustable legs 419 for controlling the angle of elevation 421, in another embodiment the separation apparatus 400 may include only two adjustable legs. In one embodiment, the two adjustable legs 419 are located at the upstream end of the frame 413. However, in another embodiment, the two adjustable legs 419 may be located in the downstream end of the frame 413. In yet another embodiment, angle of elevation 421 may controlled by any other currently existing or later developed means.

Figure 5:
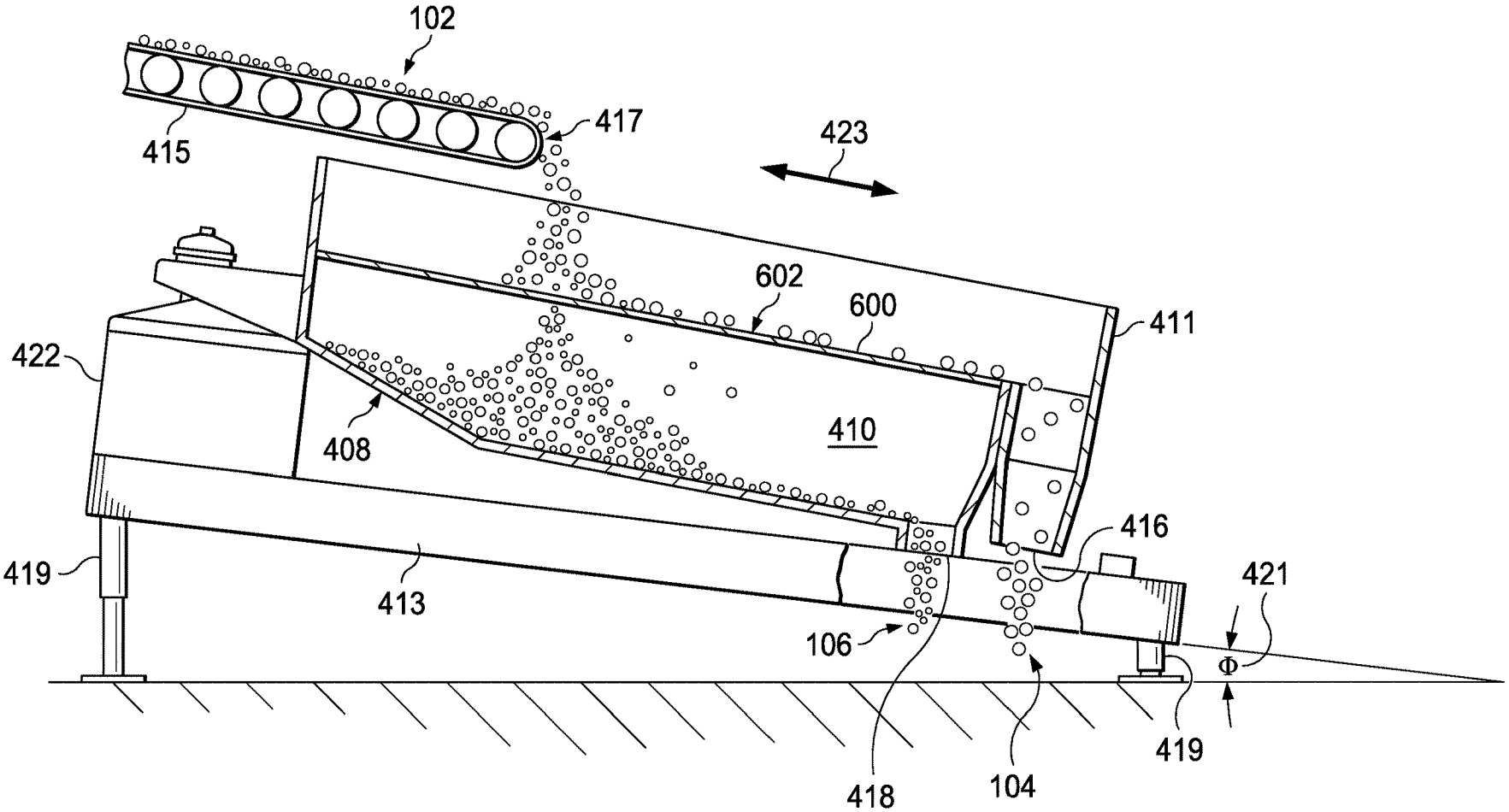
FIG. 5 is a side view of an exemplary longitudinal separation apparatus in accordance with an illustrative embodiment.

FIG. 5 is a side view of the separation apparatus shown in FIG. 4. Adjustable conveyor 415 is positioned to deposit feed stream 102 onto a selected region of separation screen 600. The exemplary feed stream 102 is shown as having small, medium, and large particles. The large particles unable to fit through the openings of separation screen 600 exit from the separation chamber 410 at outlet orifice 418 as retained product stream 104 and the small and medium particles capable of passing through the openings of the separation screen 600 exit the separation chamber 410 at outlet orifice 418 as pass-through product stream 106.

In this illustrative embodiment, the angle of elevation 421 can be altered by adjusting the set of adjustable legs 419. The selected region of separation screen 600 can be changed by changing a position of the terminal end 417 of the adjustable conveyor in the direction of the arrow 423.

Figure 6A:
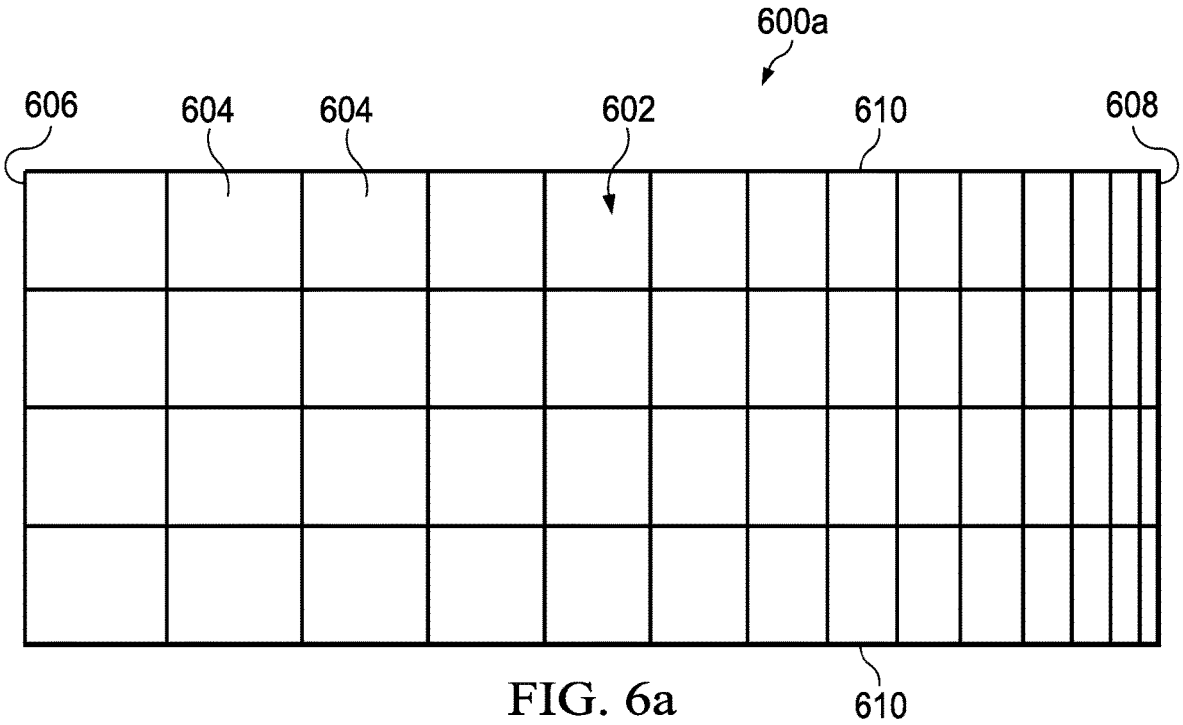
FIGS. 6*a*-6*c* are exemplary separation screens for a longitudinal separation apparatus in accordance with an illustrative embodiment.
Figure 6B:
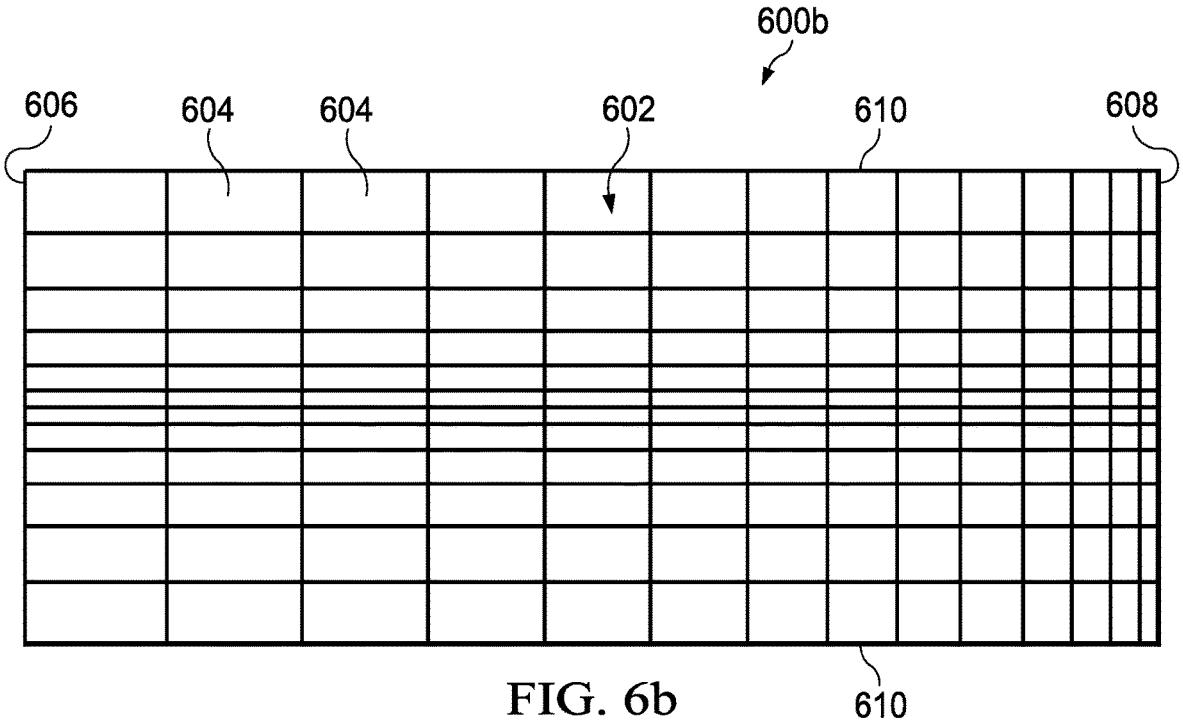
Figure 6C:
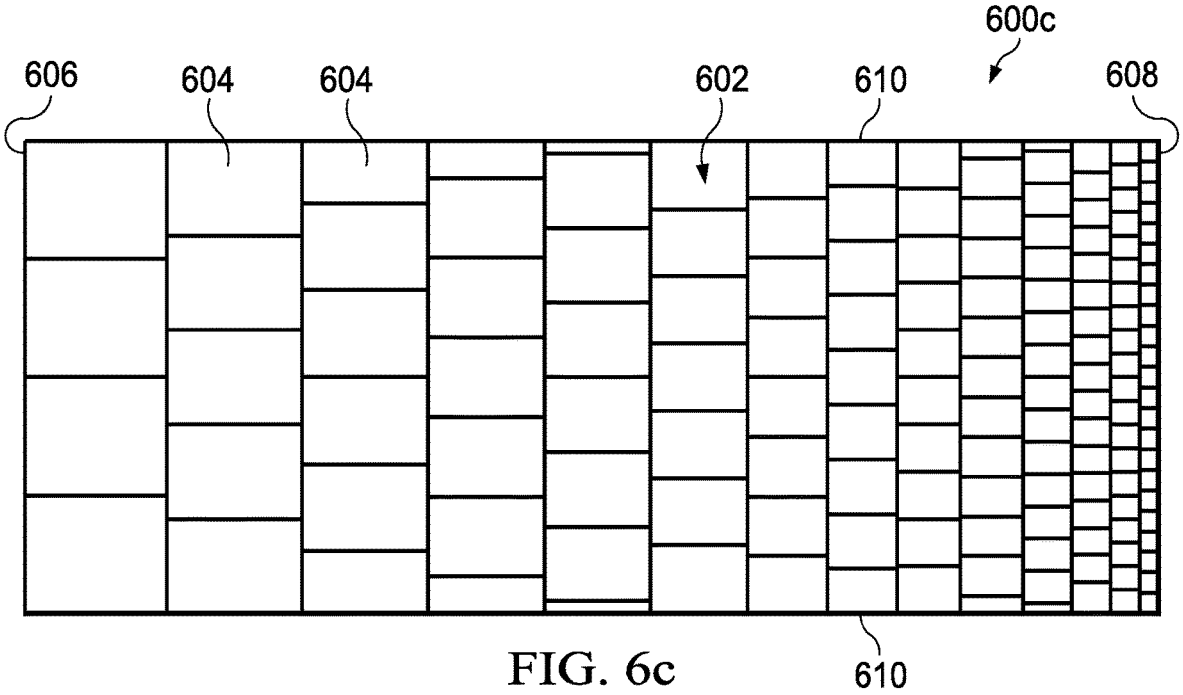

FIGS. 6*a*-6*c* depict exemplary separation screens in accordance with non-limiting embodiments. Separation screens 600*a*, 600*b*, and 600*c* have rectangular shapes, each with an operative surface 602 having a plurality of openings 604 disposed throughout. Further, each of the separation screens 600*a*, 600*b*, and 600*c* have an upstream end 606 separated from a downstream end 608 by a pair of longitudinal sides 610. Particles of a feed stream are conveyed down the operative surface 602 of the separation screens for separation into a retained product stream and a pass-through product stream, each having particles of a desired size distribution.

In each of these non-limiting embodiments, the separation screens 600*a*, 600*b*, and 600*c* have openings 604 that are fixed-size, non-uniform, and arranged in at least one size-based gradient. For example, the openings 604 at the upstream end 606 of the separation screen 600*a* are the largest, and the sizes of the openings 604 decrease steadily with increasing distance from the upstream end 606 so that the openings 604 at the downstream end 608 of the separation screen 600 have the smallest size. Thus, the size-based gradient in separation screen 600*a* is a decreasing size-based gradient in the direction from the upstream end 606 to the downstream end 608, or an increasing size-based gradient in the direction from the downstream end 608 to the upstream end 606.

Separation screen 600*b* in FIG. 6*b* has openings 604 arranged in a pattern that depicts two size-based gradients.

The first size-based gradient is similar to the one shown in separation screen 600*a* in FIG. 6*a* where the sizes of the openings 604 decrease in size with increasing distance from the upstream end 606. The second size-based gradient can be seen in the direction between the two longitudinal sides 610. In particular, the sizes of the openings 604 located along each of the longitudinal sides 610 are generally larger and decrease in size as the distance to the center decreases. Restated, the size-based gradient in the separation screen 600*b* is first decreasing then increasing in the direction from one longitudinal side 610 to the other longitudinal side 610.

Separation screen 600*c* in FIG. 6*c* depicts another separation screen in accordance with an illustrative embodiment. The separation screen 600*c* has an operative surface 602 on which a plurality of fixed-size, non-uniform openings 604 are disposed. The separation screen 600*c* has an upstream end 606 separated from a downstream end 608 by a pair of longitudinal sides 610. The plurality of openings 604 arranged on the operative surface 602 of the separation screen 600*c* are arranged in a pattern that depicts a size-based gradient similar to the one shown on separation screen 600*a*. In particular, the sizes of the openings 604 decrease with increasing distance from the upstream end 606.

In one embodiment, at least for separation screens 600*a* and 600*c*, depositing a feed stream closer towards the downstream end 608 would yield a retained product stream having medium and large sized particles and a pass-through product stream having small particle sizes. Likewise, depositing the feed stream towards the upstream end 606 would yield a retained product stream having large particle sizes, and a pass-through product stream have small and medium particle sizes. Depositing the feed stream somewhere in between the upstream end 606 and the downstream end 608 can result in a retained product stream and a pass-through product stream having a particle with mixed size distribution.

The proportions of the openings 604 in each of the separation screens 600*a-c* are exaggerated to facilitate comprehension of the novel aspects of these separation screens. One of ordinary skill in the art would know that the openings 604 may have different shapes and sizes based on a variety of other factors including, but not limited to, the type of product that forms the feed stream.

Figure 7:
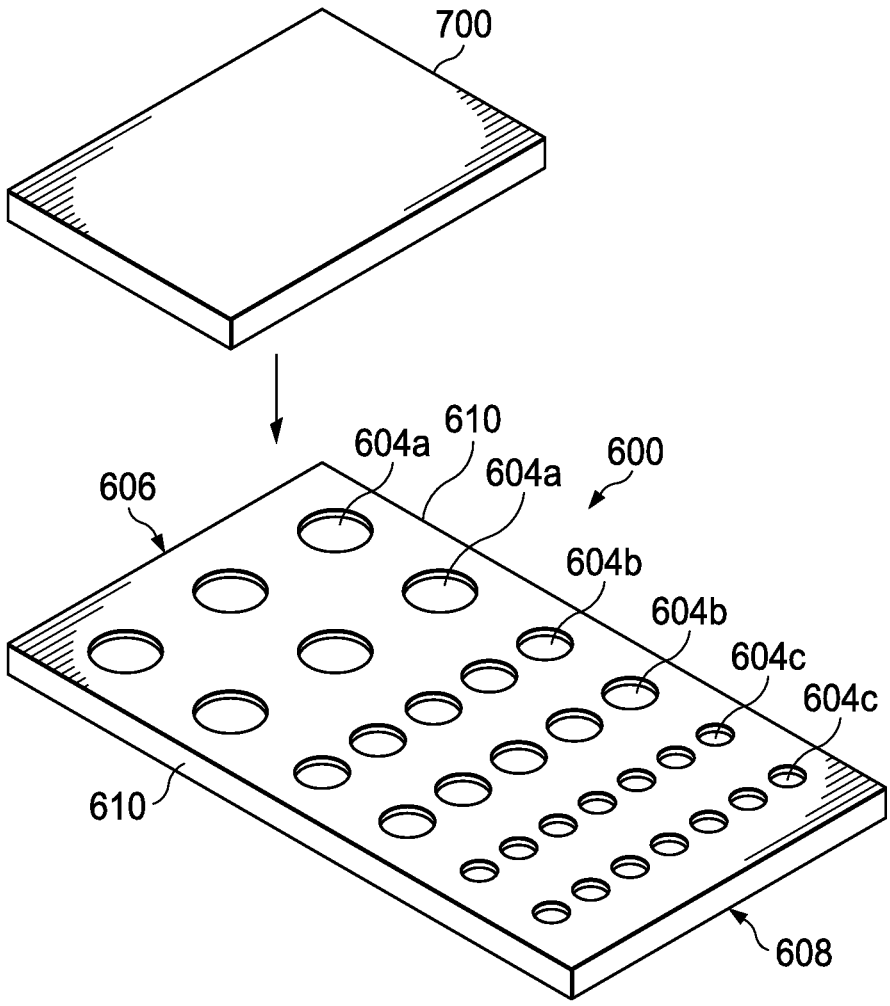
FIG. 7 is an exemplary separation screen and masking plate in accordance with another illustrative embodiment.

FIG. 7 is novel separation screen and feed placement device in accordance with another illustrative embodiment. In this embodiment, the feed placement device is a masking plate 700 that can be placed over a portion of a separation screen 600 to control where particles of a feed stream are deposited onto the separation screen 600. Separation screen 600 and masking plate 700 may be implemented in a longitudinal vibrational sifter, such as separation apparatus 500 in FIG. 5, with the masking plate 700 replacing the adjustable conveyor. Because the adjustable conveyor would be unnecessary, in this non-limiting embodiment, the feed stream 102 may be introduced into the housing 408 at one upstream location.

To provide a simple example illustrating the operation of masking plate 700 to control where a feed stream is deposited on a separation screen 600, the separation screen 600 is depicted in FIG. 7 as having only three different sizes of openings: large openings 604*a*, medium openings 604*b*, and small openings 604*c*. When installed into a longitudinal vibrational sifter, the separation screen 600 is oriented with the large openings 604*a* at the upstream end and the small openings 706 at the downstream end. In this embodiment, the feed stream 102 is always introduced into the upstream end of the separation chamber, and the exposed portions of the separation screen 600 are used to selectively separate the feed stream 102 into the desired fractions/size distributions.

In this example, a hypothetical feed stream comprising small, medium, and large spherical particles are introduced into the separation apparatus at the upstream end. By covering the large openings 604*a* with the masking plate 700, the particles of the feed stream are effectively introduced to a selected region of the separation screen 600 that has the medium openings 604*b* and small openings 604*c*. In this manner, the feed stream will be separated into a retained product stream that has only large particles, and a pass-through product stream that has small and medium particles. If the masking plate 700 is extended to cover both large openings 604*a* and the medium openings 604*b*, then the retained product stream will include both large and medium particles, and the pass-through product stream would include only the small particles. Thus, by adjusting the amount of coverage or a location of coverage, product streams having a particular size distribution can be achieved.

In one embodiment, masking plate 700 may be a cover formed from any material, such as plastic or stainless steel. Masking plate 700 may be a set of plates that can be manually inserted/locked into place and used to cover portions of the separation screen 600. Alternatively, masking plate 700 may be an extendible cover maintained in a rolled configuration in the upstream location and unrolled to mask any portion of the separation screen 600. The roll of material may be formed from film, and in one embodiment the film can be manually extended, or in another embodiment the roll of film may be configured with electromechanical components to automatically extend and retract the roll of film forming masking plate 700.

Figure 8:
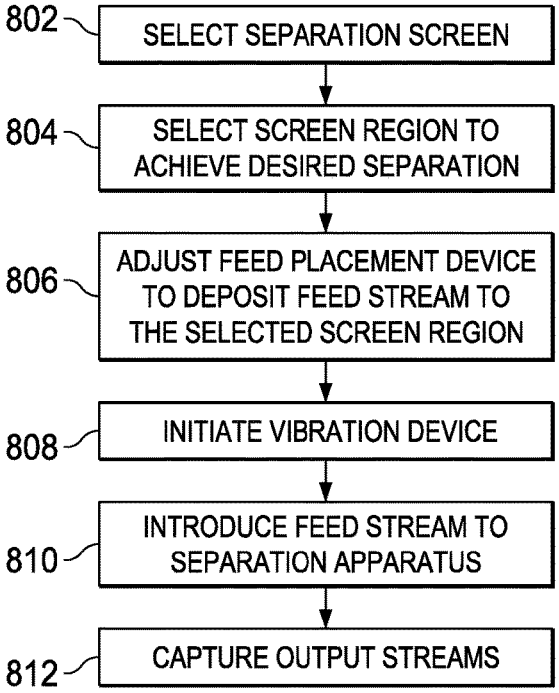
FIG. 8 is a method for product separation in accordance with an illustrative embodiment.

FIG. 8 is a method for product separation in accordance with an illustrative embodiment. The method of FIG. 8 may be implemented by any separation apparatus disclosed herein.

In a first step of the method, a separation screen is selected (Step 802). The screen pattern may be selected according to any number of different criteria, such as the type of separation system being implemented, or the type of product being separated. For example, a screen for separating potato chips could differ from a screen separating oat clusters.

Thereafter, a region of the separation screen is selected to achieve a desired separation (Step 804). Once the region of the screen has been selected, the feed placement device is adjusted to introduce/deposit a feed stream to the selected screen region (Step 806). For centrifugal screeners utilizing circular screens, the feed placement device may take the form of a feed hat, which is adjusted by manipulating a shape of the feed hat to alter its overhead footprint, which causes particles of the feed stream to be deposited onto the identified region. For longitudinal screeners utilizing rectangular screens, the feed placement device may take the form of an extendable conveyor, adjustable chute, or adjustable masking plate which can be adjusted so that the particles of the feed stream are introduced/deposited onto the identified region.

A vibration device is initiated (Step 808), and a feed stream is introduced into the separation apparatus (Step 810). The feed stream is introduced to the identified region of the separation screen, and separation is achieved as the particles are conveyed along the separation screen by the vibrational motion imparted by the vibration device. Thereafter, the product streams are captured (Step 812). If additional separation is required, one or more of the product streams may be sent to another separation chamber configured with a different screen for further separation, or re-introduced into the same separation chamber, repeating steps 804-812.

Although embodiments of the invention have been described with reference to several elements, any element described in the embodiments described herein are exemplary and can be omitted, substituted, added, combined, or rearranged as applicable to form new embodiments. A skilled person, upon reading the present specification, would recognize that such additional embodiments are effectively disclosed herein. For example, where this disclosure describes characteristics, structure, size, shape, arrangement, or composition for an element or process for making or using an element or combination of elements, the characteristics, structure, size, shape, arrangement, or composition can also be incorporated into any other element or combination of elements, or process for making or using an element or combination of elements described herein to provide additional embodiments. For example, it should be understood that the method steps described herein are exemplary, and upon reading the present disclosure, a skilled person would understand that one or more method steps described herein can be combined, omitted, re-ordered, or substituted.

Additionally, where an embodiment is described herein as comprising some element or group of elements, additional embodiments can consist essentially of or consist of the element or group of elements. Also, although the open-ended term "comprises" is generally used herein, additional embodiments can be formed by substituting the terms "consisting essentially of" or "consisting of."

While this invention has been particularly shown and described with reference to preferred embodiments, it will be understood by those skilled in the art that various changes in form and detail may be made therein without departing from the spirit and scope of the invention. The inventors expect skilled artisans to employ such variations as appropriate, and the inventors intend the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

ADDITIONAL DESCRIPTION

The following clauses are offered as further description of the novel aspects of the disclosed invention:

In a first aspect, the disclosure describes a separation apparatus for product separation, the apparatus comprising a housing defining a separation chamber having an inlet and a plurality of outlet orifices; a separation screen located within the separation chamber, wherein the separation screen comprises a plurality of openings having fixed, non-uniform sizes; and an adjustable feed placement device located upstream from the separation screen, wherein the adjustable feed placement device deposits a feed stream to a selected region of the separation screen.

Another embodiment including any one or more of the elements in a previous embodiment disclosed above, wherein the separation apparatus further comprises a vibration device attached to the housing.

Another embodiment including any one or more of the elements in a previous embodiment disclosed above, wherein the plurality of outlet orifices are located downstream from the separation screen, and wherein a retained product stream exits the separation chamber from a first outlet orifice; and a pass-through product stream exits the separation chamber from the second outlet orifice.

Another embodiment including any one or more of the elements in a previous embodiment disclosed above, wherein the feed placement device is one of a feed hat, adjustable conveyor, an adjustable chute, or masking plate.

Another embodiment including any one or more of the elements in a previous embodiment disclosed above, wherein the feed placement device is a feed hat, and wherein the feed hat comprises an adjustable effective diameter.

Another embodiment including any one or more of the elements in a previous embodiment disclosed above, wherein the feed placement device is one of the adjustable conveyor and the adjustable chute, and wherein the feed placement device comprises an adjustable terminal end.

Another embodiment including any one or more of the elements in a previous embodiment disclosed above, wherein the separation apparatus is a longitudinal sifter further comprising a set of adjustable legs attached to a frame supporting the housing, and wherein the adjustable legs alter an angle of elevation of the separation apparatus.

Another embodiment including any one or more of the elements in a previous embodiment disclosed above, wherein at least a portion of the plurality of openings are arranged in a pattern displaying a size-based gradient.

In a second aspect, the disclosure describes a separation screen comprising a plurality of openings having fixed, non-uniform sizes; wherein at least a portion of the plurality of openings are arranged in a size-based gradient.

Another embodiment including any one or more of the elements in a previous embodiment disclosed above, wherein a first set of openings in the plurality of openings has a first uniform size is at a first location on the separation screen, and wherein a second set of openings in the plurality of openings has a second uniform size at a second location on the separation screen, and wherein openings between the first set of openings and the second set of openings transitions gradually in size to form the size-based gradient.

Another embodiment including any one or more of the elements in a previous embodiment disclosed above, wherein the separation screen is circular, and wherein the first set of openings having the first uniform size is located centrally in separation screen, wherein a second set of openings having the second uniform size is located at a periphery of the separation screen, and wherein sizes of openings between the first set of openings and the second set of openings transitions gradually in size to form the size-based gradient.

Another embodiment including any one or more of the elements in a previous embodiment disclosed above, wherein the first set of openings are the largest openings, and wherein the second set of openings are the smallest openings.

Another embodiment including any one or more of the elements in a previous embodiment disclosed above, wherein the separation screen is rectangular, and wherein a first set of openings having a first uniform size is located at an upstream end of the separation screen, wherein a second set of openings having a second uniform size is located at a downstream end of the separation screen, and wherein sizes of openings between the first set of openings and the second set of openings transitions gradually in size to form the size-based gradient.

Another embodiment including any one or more of the elements in a previous embodiment disclosed above, wherein the first set of openings are the largest openings, and wherein the second set of openings are the smallest set of openings.

In a third aspect, the disclosure describes a method in a separation apparatus for product separation, the method comprising: adjusting a feed placement device to deposit a feed stream onto a selected region of a separation screen, wherein the separation screen comprises a plurality of openings having fixed, non-uniform sizes; depositing particles of the feed stream onto the selected region of the separation screen; and separating the feed stream into a retained product stream and a pass-through product stream.

Another embodiment including any one or more of the elements in a previous embodiment disclosed above, wherein the method further comprises selecting a separation screen based upon an identity of particles of the feed stream, wherein the separation screen has a pattern displaying a size-based gradient.

Another embodiment including any one or more of the elements in a previous embodiment disclosed above, wherein the method further comprises identifying the selected region of the separation screen based upon a desired size distribution of particles in either the retained product stream or the pass-through product stream.

Another embodiment including any one or more of the elements in a previous embodiment disclosed above, wherein the identifying step further comprises: correlating each of a set of feed streams with predetermined operating conditions of the separation apparatus with predetermined locations on the separation screen to obtain a desired size distribution of particles in at least one of the retained product stream and the pass-through product stream.

Another embodiment including any one or more of the elements in a previous embodiment disclosed above, wherein the method further comprises: agitating particles of the feed steam on the separation screen to cause the product separation.

Another embodiment including any one or more of the elements in a previous embodiment disclosed above, wherein adjusting the feed placement device comprises at least one of changing an effective diameter of a feed hat, adjusting a position of a terminal end of an adjustable conveyor, adjusting a position of a terminal end of a chute, or changing a coverage area of a masking plate.

We claim:

1. A separation screen comprising:

a plurality of openings having a plurality of differing fixed, sizes;

wherein at least a portion of the plurality of openings are arranged in a size-based gradient;

wherein each opening in a first set of openings in the portion of the plurality of openings has a first uniform size at a first location on the separation screen, wherein each opening in a second set of openings in the portion of the plurality of openings has a second uniform size at a second location on the separation screen, wherein the second uniform size differs from the first uniform size, and wherein a size of openings between the first set of openings and the second set of openings transition gradually in size to define at least one rank of transition openings and to form the size-based gradient such that the at least one rank of transition openings has a uniform size.

2. The separation screen of claim 1, wherein the separation screen is circular, and wherein the first set of openings having the first uniform size is located centrally in separation screen, wherein a second set of openings having the second uniform size is located at a periphery of the separation screen, and wherein sizes of openings between the first set of openings and the second set of openings transitions gradually in size to form the size-based gradient.

3. The separation screen of claim 2, wherein the first set of openings are the largest openings, and wherein the second set of openings are the smallest openings.

4. The separation screen of claim 1, wherein the separation screen is rectangular, and wherein a first set of openings having a first uniform size is located at an upstream end of the separation screen, wherein a second set of openings having a second uniform size is located at a downstream end of the separation screen, and wherein sizes of openings between the first set of openings and the second set of openings transitions gradually in size to form the size-based gradient.

5. The separation screen of claim 4, wherein the first set of openings are the largest openings, and wherein the second set of openings are the smallest set of openings.

6. A method in a separation apparatus for product separation, the method comprising:

adjusting a feed placement device to deposit a feed stream onto a selected region of a separation screen, wherein the separation screen comprises a plurality of openings having fixed, non-uniform sizes, wherein the selected region is any one of a plurality of regions of the separation screen, the selected region having openings with fixed sizes that differ from the fixed sizes of openings in at least one other region in the plurality of regions;

depositing particles of the feed stream onto the selected region of the separation screen; and separating the feed stream into a retained product stream and a pass-through product stream;

wherein adjusting the feed placement device comprises at least one of changing an effective diameter of a feed hat, adjusting a position of a terminal end of an adjustable conveyor, adjusting a position of a terminal end of a chute, or changing a coverage area of a masking plate.

7. The method of claim 6, the method comprising:

selecting a separation screen based upon an identity of particles of the feed stream, wherein the separation screen has a pattern displaying a size-based gradient.

8. The method of claim 6, the method comprising:

identifying the selected region of the separation screen based upon a desired size distribution of particles in either the retained product stream or the pass-through product stream.

9. The method of claim 8, wherein the identifying step comprises:

correlating each of a set of feed streams with predetermined operating conditions of the separation apparatus with predetermined locations on the separation screen to obtain a desired size distribution of particles in at least one of the retained product stream and the pass-through product stream.

10. The method of claim 6, the method comprising:

agitating particles of the feed steam on the separation screen to cause the product separation.

* * * * *